US010815617B2

(12) United States Patent
Olsson et al.

(10) Patent No.: US 10,815,617 B2
(45) Date of Patent: Oct. 27, 2020

(54) METHOD FOR GENERATION OF CLEAN STEAM IN A CONTINOUS DIGESTER SYSTEM

(71) Applicant: VALMET AB, Sundsvall (SE)

(72) Inventors: Krister Olsson, Karlstad (SE); Jari Miettinen, Karlstad (SE); Keyla Miettinen, Karlstad (SE); Kjell Ljungkvist, Gothenburg (SE)

(73) Assignee: VALMET AB, Sundsvall (SE)

( * ) Notice: Subject to any disclaimer, the term of this patent is extended or adjusted under 35 U.S.C. 154(b) by 78 days.

(21) Appl. No.: 16/301,602

(22) PCT Filed: May 16, 2017

(86) PCT No.: PCT/SE2017/050511

§ 371 (c)(1),
(2) Date: Nov. 14, 2018

(87) PCT Pub. No.: WO2017/200470

PCT Pub. Date: Nov. 23, 2017

(65) Prior Publication Data

US 2019/0218712 A1 Jul. 18, 2019

(30) Foreign Application Priority Data

May 17, 2016 (SE) ..... 1650664

(51) Int. Cl.

| | |
|---|---|
| ***D21C 11/06*** | (2006.01) |
| ***D21C 1/02*** | (2006.01) |
| ***D21C 3/24*** | (2006.01) |
| ***D21C 7/10*** | (2006.01) |

(52) U.S. Cl.
CPC ..... *D21C 11/06* (2013.01); *D21C 1/02* (2013.01); *D21C 3/24* (2013.01); *D21C 7/10* (2013.01)

(58) Field of Classification Search
CPC ..... D21C 11/06
See application file for complete search history.

(56) References Cited

U.S. PATENT DOCUMENTS

| | | | | |
|---|---|---|---|---|
| 2,029,360 A | | 2/1936 | Dean | |
| 3,816,239 A | | 6/1974 | Marks | |
| 4,111,743 A | * | 9/1978 | Ronnholm | D21C 11/0007 162/16 |

(Continued)

FOREIGN PATENT DOCUMENTS

| | | |
|---|---|---|
| WO | WO 2007/073333 A1 | 6/2007 |
| WO | WO 2015/132469 A1 | 9/2015 |

*Primary Examiner* — Anthony Calandra
(74) *Attorney, Agent, or Firm* — Foley & Lardner LLP

(57) ABSTRACT

The invention relates to an improved method for generating clean steam in a digester plant of a chemical pulp mill. By feeding a steam-to-steam converter (SSC) with venting steam from a black liquor flash tank (FT) as well as venting steam from chip steaming (SV) could the volume of clean steam produced be increased by over 40-50%, and to such an extent that the volume of clean steam covers the needs for preheating of chips in the digester system also in severe operational conditions. The total consumption of clean steam from the steam net of the mill may be reduced and used for other purposes such as electricity production, which meets the requirements for converting the pulp mill to an environmental friendly pulp mill.

10 Claims, 4 Drawing Sheets

(56) References Cited

U.S. PATENT DOCUMENTS

| | | | | |
|---|---|---|---|---|
| 5,547,546 | A | 8/1996 | Prough et al. | |
| 5,547,565 | A | 8/1996 | Biere et al. | |
| 5,865,948 | A | 2/1999 | Lora et al. | |
| 6,176,971 | B1 | 1/2001 | Sun Yu et al. | |
| 6,306,252 | B1 | 10/2001 | Ryham | |
| 6,375,795 | B2 | 4/2002 | Lebel et al. | |
| 6,468,390 | B1 * | 10/2002 | Snekkenes | D21C 3/02 162/19 |
| 6,722,130 | B1 * | 4/2004 | Snekkenes | D21C 11/06 60/648 |
| 2010/0236733 | A1 | 9/2010 | Tikka et al. | |

* cited by examiner

METHOD FOR GENERATION OF CLEAN STEAM IN A CONTINOUS DIGESTER SYSTEM

BACKGROUND OF INVENTION

The present invention relates to a method for generation of clean steam in continuous digester systems.

Conventionally, in older continuous digester systems have a chip bin and a subsequent steaming vessel been used for steaming/heating the cellulose material not only for the expulsion of air but also of the preheating of the chips before the cook.

Initial steaming in chip bin may be used by adding steam in the bottom of the chip bin either as steam-blow through to the top or with so called cold top control where steam was not allowed to blow trough. Blow-through steaming frequently used fresh low pressure steam from the steam net, reaching a temperature in the range 80-100° C., while turpentine may be extracted from the vented steam while cold-top control most often used flash steam.

The subsequent final steaming in steaming vessel normally used flashed steam from black liquor flash tanks, reaching a temperature of 100-120° C. The vent gases from steaming vessel was typically collected and sent to condensers that could form condensate from all condensable gases such as water, turpentine etc., and the non-condensable gases from the condenser was passed to incinerator for final destruction. The non-condensable gases typically contained malodorous gases. Conventionally the vent gases from chip bin has a low concentration, i.e. diluted with air, and is handled as HVLC gases (High Volume & Low Concentration); while the vent gases from steaming vessel has a high concentration, i.e. less diluted with air, and is handled as LVHC gases (Low Volume & High Concentration). The vented gases differs considerably as HVLC has a concentration above the range where the gas is easily ignitable, while LVHC has a concentration below the range where the gas is ignitable. The flash steam used in chip bin and steaming vessel contained volatile gases such as hydrogen sulfide, methyl mercaptan, dimethyl sulfide and dimethyl disulfide, that even in small doses about single digit ppm concentration could spread a sticky smell miles around a mill.

Actions was taken that malodourous gases should not leak against the flow of cellulose material fed through the chip bin and steaming vessel. Hence, in U.S. Pat. No. 6,375,795 is a system disclosed where malodorous gases from a low pressure feeder between chip bin and steaming vessel are vented from the low pressure feeder and fed back to outlet end of the steaming vessel.

Vent gases from both chip bin and steaming vessel may also be collected in a common flow and sent to condenser, as also disclosed in both of U.S. Pat. Nos. 5,547,546 and 5,865,948.

In order to reduce consumption of fresh low pressure steam from the steam net has also been proposed to generate clean steam from hot spent cooking liquor, and this option is shown in U.S. Pat. Nos. 6,306,252 and 6,176,971, the latter increasing the potential volumes of fresh low pressure steam by implementing an educator, fan or compressor which could subject the clean steam generation process to lower pressure and hence extract more heat value from the hot black liquor. One of the solutions mentioned in U.S. Pat. No. 6,176,971 use an educator driven by clean steam from the steam net, which is a less valuable options for saving clean steam from the steam net.

A system is revealed in U.S. Pat. No. 6,722,130 for the generation of pure steam from black liquor in which the pressure of the black liquor is first reduced in order to produce black liquor at atmospheric pressure and black liquor vapor, where this black liquor steam is condensed in subsequent steps and form the pure steam from this condensate. A system was revealed long ago in U.S. Pat. No. 2,029,360 in which a steam converter is used in order to heat a pure process fluid for the generation of pure steam in a steam converter in the form of a heat exchanger. A variant was also revealed here in which the quantity of expelled clean steam in the heated clean process fluid can be increased by injecting steam into this heated process fluid.

Thus has several different solutions been disclosed for generating clean steam for steaming chips ahead of the continuous digester. However, in many continuous digester systems the need for clean steam in chip steaming may be higher than is possible to extract from black liquor reboilers and/or steam-to-steam converters, especially for those mills operating in cold climate with ambient temperature well below minus 20-30° C., where cellulose material is stored in outside storage stacks and thus holds the same temperature and additionally may bring in also large volumes of snow and ice with the cellulose material.

SUMMARY OF INVENTION

The invention is related to a method for generation of clean steam in a continuous digester system, where the continuous digester system comprises

- a chip bin using clean steam for initial steaming of cellulose material fed to the chip bin in order to heat the cellulose material and reduce amount of air in the cellulose material flow;
- a steaming vessel using dirty steam for a subsequent steaming of the cellulose material fed to the steaming vessel and where a stream of vent gases are withdrawn from the steaming vessel containing at least a part of the bound air in the cellulose material fed to steaming vessel;
- slurrying means for slurrying the cellulose material that has been steamed to a desired concentration of solids in the slurry formed;
- transfer means for transferring and pressurizing the slurry to the top of at least one treatment vessel, wherein at least one zone of one treatment vessel contains a cooking zone kept at full cooking temperature;
- an extraction screen in or immediately following the cooking zone extracting at least spent cooking liquor kept at temperature in a range between full cooking temperature, said full cooking temperature kept in the range 135 to 175° C. at the most and 120° C. at the lowest if the spent cooking liquor is diluted with wash liquor added after the cooking zone in a countercurrent wash zone;
- at least on flash tank in a series of flash tanks receiving the extracted spent cooking liquor, that reduce the pressure of the extracted spent cooking liquor and generates dirty flash steam from the extracted spent cooking liquor;

In such digester system the method is characterized in that the dirty flash steam as well as the stream of vent gases from the steaming vessel is led to a common steam-to-steam converter, and where a clean steam is evaporated from clean water fed to the steam-to-steam converter by indirect heating from the dirty flash steam as well as the stream of vent gases from the steaming vessel.

By feeding both the flash steam as well as the vent steam from steaming vessel to one and the same steam-to-steam converter could the amount of clean steam produced be increased by over 40-50%, and substantial savings in clean steam from the steam net of the pulp mill be obtained, and the investment costs for a steam-to-steam converter be better motivated.

In a preferred embodiment of the inventive method is the amount of steam in the stream of vent gases from the steaming vessel fed to the common steam-to-steam converter exceeding 0.10 ton of steam per ton of air dried cellulose material fed to the digester system. This corresponds to an amount that typically corresponds to the major part of vent steam from the steaming vessel.

In yet a preferred embodiment of the invention is the amount of steam in the dirty flash steam fed to the common steam-to-steam converter exceeding 0.15 ton of steam per ton of air dried cellulose material fed to the digester system.

In an application of the invention is also preferably the temperature of the stream of vent gases from the steaming vessel at least 110° C. and the temperature of the dirty flash steam at least 105° C. By these lower temperatures could still substantial volumes of clean steam be produced in the steam-to-steam converter and at a pressure sufficient for use in at least chip presteaming.

In another modification of the inventive method may also the stream of vent gases from the chip bin be led to the common steam-to-steam converter. Hence, the total vent flow from chip pre steaming is thus used in the steam-to-steam converter, optimizing the total production of clean steam volumes.

The basic concept of the inventive method may thus also involve that the stream of vent gases from the steaming vessel as well as the dirty flash steam from the flash tanks are mixed into one common flow of dirty steam laden gases before being fed to the common steam-to-steam converter. This alternative result in a simple lay out of the gas handling system, with one single feed pipe from the chip feeding location in the digester system and to the flash tank and steam-to-steam converter location of the digester system.

In an alternative embodiment for special operations of the digester system could also the stream of vent gases from the chip bin be forwarded and led to and through the common steam-to-steam converter in separate ducting system keeping the vent gases from the chip bin unmixed through the common steam-to-steam converter. This may be sought for in Bio mills where they also recover Sulphur free turpentine from the vent gases from chip bin where steaming is done using clean steam. In this embodiment is the HVLC and LVHC gases kept separated and risk for igniting the gases is reduced.

In a further modification of the inventive method could also after passage of the steam-to-steam converter is at least the remnant steam flows from the stream of vent gases from the steaming vessel as well as the dirty flash steam from the flash tanks led to a condenser for condensing remnant condensable gases, and after passage through the condenser is the remnant gases led to final incineration for destruction of non-condensable gases. This implementation thus provides for a common handling of remaining malodourous gases from the digester, and hence a lower investment cost for a total handling system.

In a final modification of the inventive method may also after passage of the steam-to-steam converter is at least turpentine extracted from the remnant steam flow from the stream of vent gases from the chip bin, and preferably by subjecting this remnant flow from the stream of vent gases from the chip bin to further cooling. This embodiment is advantageously implemented in soft wood pulp mills where the turpentine content is relatively high in the initial chip steaming process, and results in further revenues for the pulp mill besides pulp sales.

DETAILED DESCRIPTION

Figure 1:
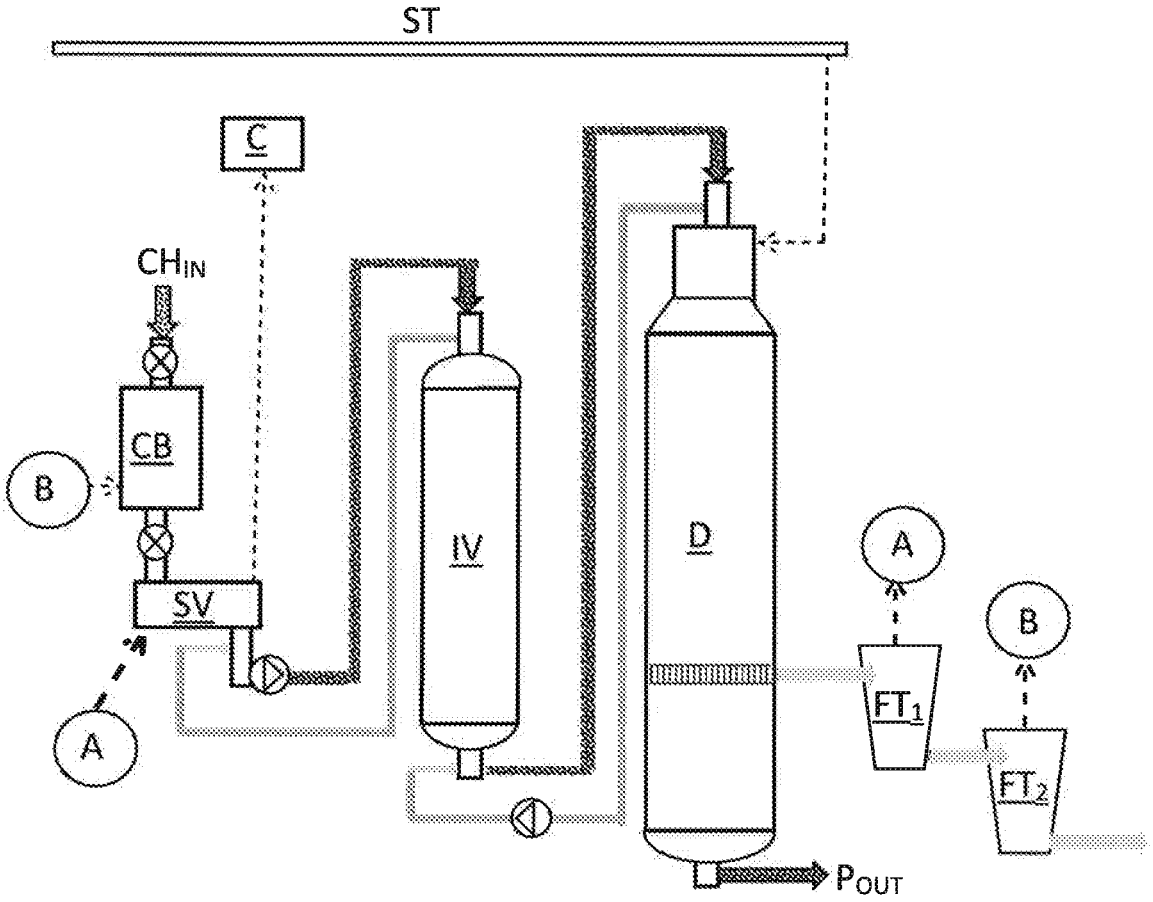
Prior Art Fig. 1
FIG. 1 shows schematically a conventional 2-vessel digester system.

FIG. 1 illustrates schematically a conventional 2-vessel digester system.

The cellulose material, preferably in form of wood chips, flows to a chip bin CB via a chip meter. In many chips bins the chips are pre-steamed already in chip bin. This pre-steaming results in reduction of the most part of the free air in the chips flow but also a small part of the air bound in chips, as well as an initial heating of chips. Most often is flash steam used in the chip bin, but some chip bins use only clean steam from the steam net. The flash steam is typically obtained from a second flash tank $FT_2$. Steaming in chip bin may be done in blow through fashion where clean steam is added in bottom and expelled in top. Steaming may also be done using dirty steam without blow trough of steam, and instead used cold top control of steam addition in bottom.

After the chip bin is the chips steamed in a conventional pressurized steaming vessel SV, and a low pressure sluice feeder in inlet is used to enable application of higher pressure and thus higher temperature in the steaming vessel. This steaming phase is used to further reduce the amount of air bound in the chips. There is a vent in the steaming vessel and a degassing flow is sent to condensation system. In most conventional systems is flash steam from a first flash tank $FT_1$ used for steaming in steaming vessel.

Once the steaming is concluded and most of the air bound in the cellulose material has been driven off, the chips fall down in a chute where cooking liquor is added forming a slurry of chips. The chip slurry is sent to the top of a treatment vessel, here an impregnation vessel IV, using either a conventional high pressure sluice feeder, or as indicated here with a pump. Excess transport liquor is separated in top of the impregnation vessel and returned to chute. After impregnation, the chips slurry is sent to top of a digester vessel D where cooking and delignification takes place at full digester temperature in the range 140-180°. In order to reach full digester temperature must heating be done in digester top, which may be done by injecting direct steam from the steam net of the mill into the digester top.

At end of cook is spent cooking liquor at full cooking temperature, or lowest at 120° C., extracted via extraction screens and sent to a series of flash tanks $FT_1$ and $FT_2$ where the hot spent liquor flash off steam. Finally at end of digester is the cooked cellulose pulp $P_{OUT}$ fed out from digester.

As shown in this figure was the steam partly reused in the system as the flash steam from the first flash tank was used for steaming in the steaming vessel, and flash steam was still used for steaming in chip bin, as there could be risks for blow through of malodourous gases, and flash steam from the second flash tank was used for heating towards full cooking temperature. Usage of direct steam for heating to cooking temperature, mostly for steam phase digesters, is the less expensive investment, but lead to dilution of cooking liquor with absolutely clean steam condensate and involves higher operational costs for generating replacement water with the same purity in the steam net.

Figure 2:
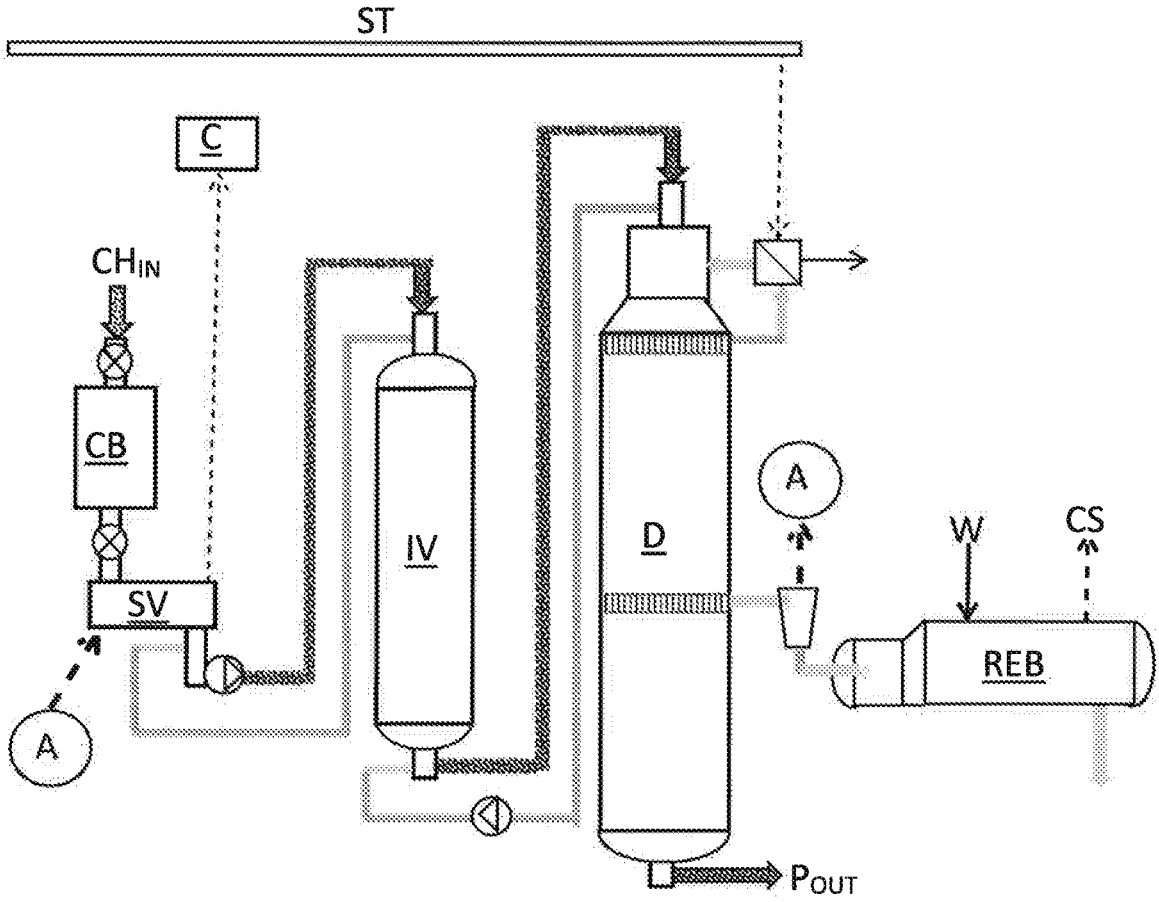
Prior Art Fig. 2
FIG. 2 shows a modification of a conventional 2-vessel digester system where a reboiler is used.

FIG. 2 illustrates schematically an improvement of the conventional 2-vessel digester system, but using a reboiler for generation of clean steam. The hot spent cooking liquor is sent to the reboiler REB, typically a kettle reboiler, where it indirectly heats a pool of clean water W fed to reboiler and driving off clean steam via outlet flow A. The clean steam CS produced could be used for the steaming process of the chips, as shown in U.S. Pat. No. 6,306,252. If more steam was needed could also the reboiler be put under lower pressure using an steam driven educator, as shown in U.S. Pat. No. 6,176,971, but then at the expense of clean steam and dilution effects. Indirect heating in digester top is used in a digester circulation sent to an indirect heat exchanger, and steam from the steam net may be used without dilution effects as the steam condensate is recovered separately.

Figure 3:
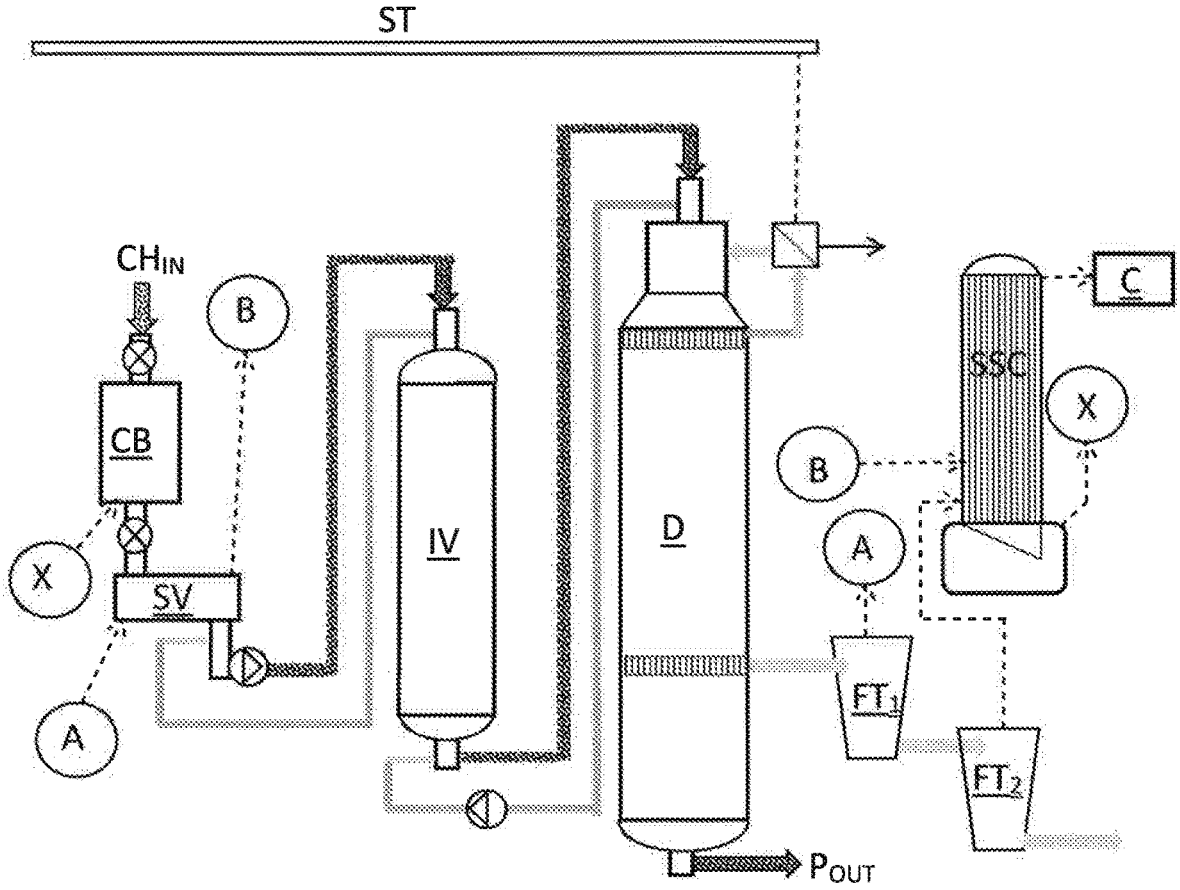
FIG. 3 shows the principle application of a steam-to-steam converter according to the invention in similar 2-vessel digester system.

In FIG. 3 is a modification of the steam recovery system in similar 2-vessel digester system according to the invention. Here is a steam-to-steam converter SSC installed and being fed by both flash steam from a flash tank $FT_2$ as well as vent steam from steaming vessel SV, collected at B. And the converted clean steam is obtained at X and used for steaming the chips. As shown here may only clean steam from the steam net of the mill be used to heat the digester top to full cooking temperature, which may be implemented as shown as a heating circulation in the top of an hydraulic digester or alternatively as steam addition to the vapor phase in a vapor phase digester. The function of the steam-to-steam converter will be more described in detail in FIG. 4 using the implementation data for a digester system with a production capacity of pulp at about 1180 adt/day. (adt=air dried ton, where 1 ton of air dried ton corresponds to 0.9 ton of bone dry ton). Thus, this production capacity is quite low today and corresponds to top production capacity in the early 1970ies, while production capacity of today may exceed 6000 adt/day. But numerous digesters from the 1970ies are still in operation and are subject to steam economy improvements.

Example of Implementation

Figure 4:
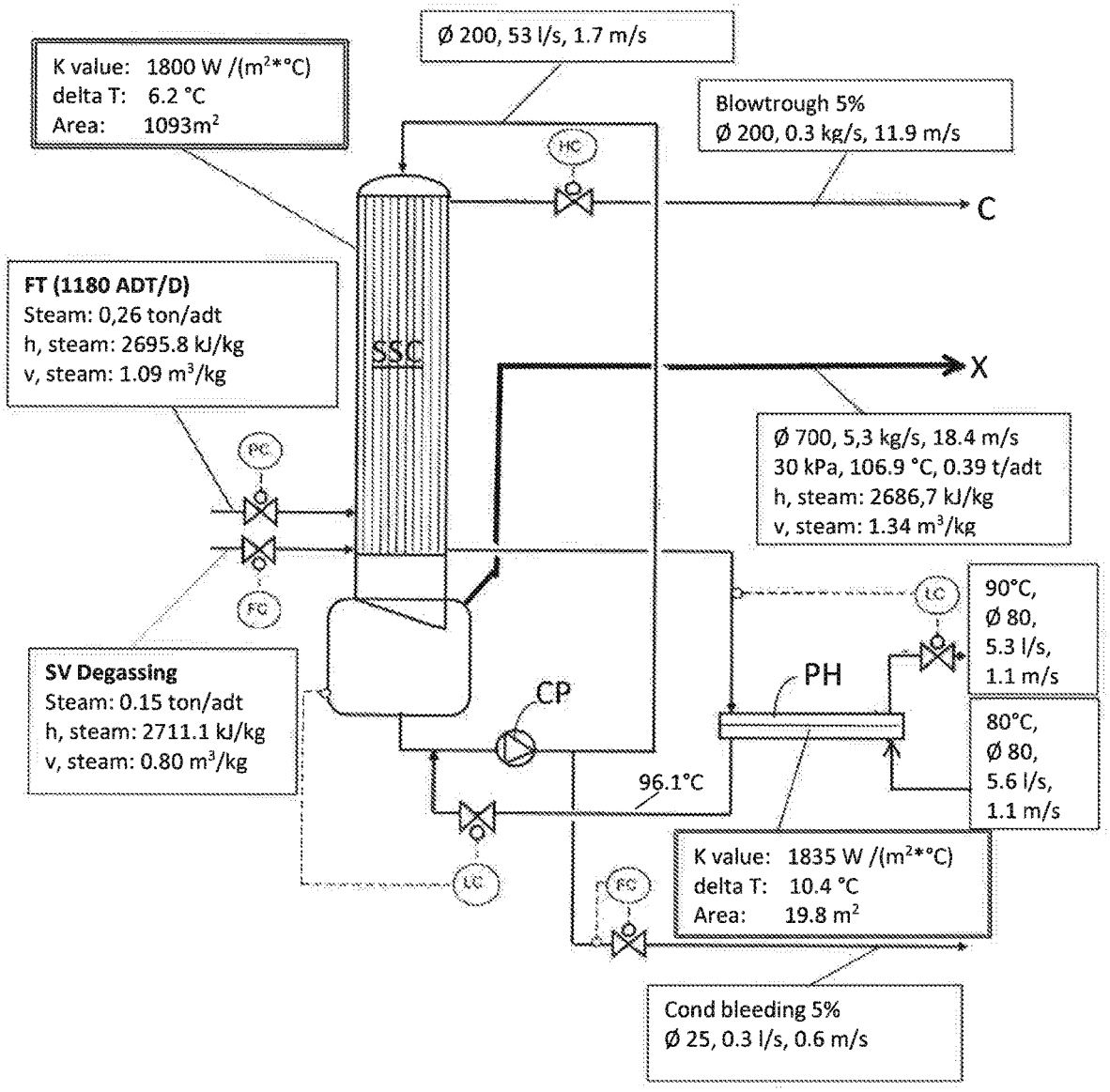
FIG. 4 show detail flow data for the steam-to-steam converter for a digester system with a production capacity of 1180 adt/day.

As shown from the design data as disclosed in FIG. 4 has the steam-to-steam converter SSC a total heat exchange area of 1093 $m^2$, with a K value of 1800 W/($m^2$*° C.) and a delta T of about 6.2° C. There is also a small preheater PH used to heat fresh clean replacement water, with a total heat exchange area of 19.8 $m^2$, with a K value of 1835 W/($m^2$*° C.) and a delta T of about 10.4° C.

The dirty side of the steam-to-steam converter SSC is fed with steam from the flash tank FT at an amount of 0.26 ton/adt of pulp produced, at a heat value of 2695.8 kJ/kg and in a volume of 1.09 $m^3$/kg. The flash steam is forwarded in a piping with diameter of 500 mm, at a rate of 19.7 m/s and 12.8 ton/h (3.6 kg/s). The dirty side of the steam-to-steam converter SSC is also fed with steam from the steaming vessel SV at an amount of 0.15 ton/adt of pulp produced, at a heat value of 2711.1 kJ/kg and in a volume of 0.80 $m^3$/kg. The vent steam from steaming is forwarded in a piping with diameter of 300 mm, at a rate of 23.2 m/s and 7.4 ton/h (2.0 kg/s). A small blow trough of about 5% is ventilated from the dirty side and sent to condenser, and this flow is forwarded in a piping with diameter of 200 mm, at a rate of 11.9 m/s and 0.3 kg/s. Dirty condensate is bled off at a rate of about 5% to a preheater PE, and this flow is forwarded in a piping with diameter of 80 mm, at a rate of 1.1 m/s and 5.3 l/s.

The clean side of the steam-to-steam converter SSC is supplied with clean water (or condensate) and is under constant circulation by a circulation pump CP, withdrawing hot water from bottom of SSC and adding it to the top, flushing hot water over the heat exchanger surface. The clean steam is extracted from the lower part of the SSC behind a deflector skirt, and the amount of clean steam is generated in amount of 0.39 ton/adt of pulp produced, at a heat value of 2686.7 kJ/kg and in a volume of 1.34 $m^3$/kg. The clean steam is forwarded in a piping with diameter of 700 mm, at a rate of 18.4 m/s and 19.1 ton/h (5.3 kg/s). The clean steam holds a pressure of about 30 kPa and a temperature of 106.9° C. As steam is continuously boiled off from the circulation is fresh clean water added to replace it, and in this example is the replacement water first heated in the pre heater PE using the residual heat value of the dirty condensate. The fresh water added is holding a temperature of about 80° C., and after heating in PE reach a temperature of about 96.1° C., and is added in a piping with diameter of 80 mm, at a rate of 1.1 m/s and 5.3 l/s. The preheated replacement water is preferably added directly into the circulation (using level control for controlling the supply). A small volume of is bled off from the circulation at a rate of about 5%, and this flow is forwarded in a piping with diameter of 25 mm, at a rate of 0.3 l/s and 0.6 m/s.

Compared with feeding the steam-to-steam converter with only flash steam, the amount of clean steam generated increased from 0.25 ton/adt to 0.39 ton/adt, which corresponds to an increase of 0.14 ton/adt, i.e. 56%. The investment of a steam-to-steam converter could therefore better be motivated and may cover the total clean steam needs for the pre steaming and steaming system. More of the steam from the steam net of the mill i.e. that produced conventionally in the recovery boiler dome, could be used for energy production in steam driven generators producing environmental friendly electricity from recovery operations that classifies as "green" electricity as it is produced from energy recovery.

The invention claimed is:

1. A method for generation of clean steam in a continuous digester system, where the continuous digester system comprises a chip bin using clean steam for an initial steaming of a cellulose material fed to the chip bin in order to heat the cellulose material and reduce an amount of air in a flow of the cellulose material;

a steaming vessel using dirty steam for a subsequent steaming of the cellulose material fed to the steaming vessel wherein a stream of vent gases are withdrawn from the steaming vessel containing at least a part of bound air in the cellulose material fed to the steaming vessel;

a path and liquor connection for slurrying the cellulose material that has been steamed in the steaming vessel to form a concentration of solids in a slurry;

a feeder for transferring and pressurizing the slurry to a top of at least one treatment vessel, wherein at least one zone of the at least one treatment vessel contains a cooking zone kept at full cooking temperature, said full cooking temperature kept in the range 135 to 175° C.;

an extraction screen in, or immediately following the cooking zone, extracting at least a spent cooking liquor kept at temperature in a range from 120 to 175° C. to form an extracted spent cooking liquor;

at least one flash tank in a series of flash tanks for receiving the extracted spent cooking liquor, wherein the at least one flash tank reduces the pressure of the extracted spent cooking liquor and generates dirty flash steam from the extracted spent cooking liquor;

the method comprising:

leading the dirty flash steam as well as the stream of vent gases from the steaming vessel to a common steam-to-steam converter; and evaporating a clean steam from clean water fed to the steam-to-steam converter by indirect heating from the dirty flash steam as well as the stream of vent gases from the steaming vessel.

2. The method according to claim 1, wherein the amount of steam in the stream of vent gases from the steaming vessel fed to the common steam-to-steam converter exceeds 0.10 ton of steam per ton of air dried cellulose material fed to the digester system.

3. The method according to claim 2, wherein the amount of steam in the dirty flash steam fed to the common steam-to-steam converter exceeds 0.15 ton of steam per ton of air dried cellulose material fed to the digester system.

4. The method according to claim 3, wherein the temperature of the stream of vent gases from the steaming vessel is at least 110° C. and the temperature of the dirty flash steam is at least 105° C.

5. The method according to claim 4, wherein a stream of vent gases from the chip bin is led to the common steam-to-steam converter.

6. The method according to claim 1, wherein the stream of vent gases from the steaming vessel as well as the dirty flash steam from the flash tanks are mixed into one common flow of dirty steam laden gases before being fed to the common steam-to-steam converter.

7. The method according to claim 5, wherein the stream of vent gases from the chip bin is forwarded and led to and through the common steam-to-steam converter in a separate ducting system keeping the vent gases from the chip bin unmixed through the common steam-to-steam converter.

8. The method according to claim 1, wherein, after passage of the steam-to-steam converter, at least remnant steam flows from the stream of vent gases from the steaming vessel as well as the dirty flash steam from the flash tanks are led to a condenser for condensing remnant condensable gases, and after passage through the condenser the remnant gases are led to final incineration for destruction of non-condensable gases.

9. The method according to claim 7, wherein, after passage of the steam-to-steam converter, at least turpentine is extracted from remnant steam flow from the stream of vent gases from the chip bin.

10. The method according to claim 9, wherein the remnant steam flow from the stream of vent gases from the chip bin is subjected to further cooling.

* * * * *